US008043163B2

(12) United States Patent
Proplesch

(10) Patent No.: US 8,043,163 B2
(45) Date of Patent: Oct. 25, 2011

(54) PRACTICE AID FOR GOLFERS

(76) Inventor: Dieter Proplesch, Sprockhovel (DE)

( * ) Notice: Subject to any disclaimer, the term of this patent is extended or adjusted under 35 U.S.C. 154(b) by 188 days.

(21) Appl. No.: 12/521,418

(22) PCT Filed: Dec. 20, 2007

(86) PCT No.: PCT/EP2007/064323

§ 371 (c)(1),
(2), (4) Date: Jun. 26, 2009

(87) PCT Pub. No.: WO2008/080880

PCT Pub. Date: Jul. 10, 2008

(65) Prior Publication Data

US 2010/0317449 A1 Dec. 16, 2010

(30) Foreign Application Priority Data

Dec. 27, 2006 (DE) ..... 10 2006 062 299
Jun. 18, 2007 (EP) ..... 07110474
Oct. 15, 2007 (EP) ..... 07118472

(51) Int. Cl.
*A63B 69/36* (2006.01)

(52) U.S. Cl. ..... 473/214; 473/276

(58) Field of Classification Search ..... 473/212, 473/214, 276, 268, 270; 273/DIG. 30; 602/20, 602/61, 75; 606/201, 204
See application file for complete search history.

(56) References Cited

U.S. PATENT DOCUMENTS 802,623 A * 10/1905 Camp ..... 473/214
2,468,580 A * 4/1949 Weis et al. ..... 473/214
2,809,042 A * 10/1957 Wasley ..... 473/214
3,900,199 A * 8/1975 McGonagle ..... 473/214
3,990,709 A * 11/1976 DeRogatis ..... 473/214
5,048,837 A * 9/1991 Manley et al. ..... 473/214
5,069,457 A * 12/1991 Korzenowski ..... 473/214
5,203,570 A * 4/1993 Graham ..... 473/214
5,425,539 A * 6/1995 Steffes ..... 473/214
5,445,385 A * 8/1995 Brooks ..... 473/214
5,667,447 A * 9/1997 Perham et al. ..... 473/212
5,704,846 A 1/1998 Johnson
5,743,806 A * 4/1998 Brennan ..... 473/214
D460,824 S * 7/2002 Ames ..... D24/190
7,775,898 B1 * 8/2010 Allen ..... 473/214
7,789,763 B1 * 9/2010 Smith ..... 473/214
2009/0253527 A1 * 10/2009 Abraham ..... 473/214
2010/0190564 A1 * 7/2010 Lindby ..... 473/214
2010/0317449 A1 * 12/2010 Proplesch ..... 473/214

* cited by examiner

*Primary Examiner* — Raleigh W. Chiu
(74) *Attorney, Agent, or Firm* — Steven M. Hoffberg; Ostrolenk Faber LLP

(57) ABSTRACT

A practice aid (22) for golfers (10), which is formed by a jacket-shaped textile upper part (24) with at least one tubular-shaped sleeve (26, 28). The sleeve (26, 28) comprises a stiffening and follows the motion sequence of the golfer (10) when hitting with the golf club (14). The stiffening is formed as a frame (30) and is provided in the tubular sleeve (26, 28). Furthermore, the invention relates to a practice aid (22) for golfers (10) designed as a stiffening frame (30).

20 Claims, 5 Drawing Sheets

PRACTICE AID FOR GOLFERS

FIELD OF THE INVENTION

The present invention relates to a practicing aid for golfers, influencing the motion sequence of the golfer when swinging with the golf club, wherein the practicing aid is provided at the arm of the golfer.

BACKGROUND OF THE INVENTION

Golf is a ball game played on grass land in naturally or only slightly modified terrain. It is the aim of golfing, to hit a small, hard ball (golf ball) with a club on courses of different lengths into a hole with as few hits as possible.

Usually, a golf course is designed with 9 or 18 holes which are several hundred meters long. Each course starts with a teeing area, which is followed by a fairway for further playing. At the end of the fairway there is a green with lawn which is cut very short and with the hole as a goal. The course is surrounded with uncut grass (rough), scrubland, trees, water and artificial obstacles, such as sand-filled bunkers. The hole is marked with a flag for better recognition.

In order to hit the golf ball, a player can choose one out of 14 different clubs with different club heads depending on the ground and the desired trajectory. On the tee or on the fairway, the player wants to hit the ball as far and as precisely as possible. For this purpose, the player has to hit the ball with the head of the club with high speed and accordingly with high kinetic energy in order to achieve an optimum power transfer to the ball. Both the direction and the amount of the transmitted power should be as exact as possible in accordance to the necessary values of the desired trajectory.

In order to carry out such a hit, usually a player first moves the club far behind his head. The club head is then guided in a circular and swinging motion to the ball. When hitting the ball, a part of the kinetic energy of the club head is transmitted to the ball. The player then lets the club continuously swing in a circle. This motion, which is also called a golf swing, is a technically very demanding motion sequence. Beside a movement of the arms, a rotation of the shoulders, torso and hips must be effected. Thereby, the weight of the player is shifted from one leg to the other. The golf swing requires a good sense of rhythm, timing and accuracy from the player.

Especially beginners and inexperienced players often have significant problems in learning the optimum motion of a golf swing. A large number of individual movements must be coordinated during the swing and attention must be paid to the position of all body parts to each other. Furthermore, the golf ball also has to be hit and must be played in a desired direction. An incorrect motion sequence of the golf swing often causes an unsatisfactory golf play. The player can lose the fun of playing golf. Furthermore, a faulty motion sequence involves the risk of sport injuries. Joints and muscles may be incorrectly and destructively stressed.

An entire industry sector of the clothing industry deals with sport-suitable golf clothing. Further, the fashionable aspects and golf etiquette and functional properties of golf clothing are considered to be of high importance. The golf clothing should protect the golf player from disadvantageous weather conditions and should provide an optimal body climate, in particular without limiting the mobility of the golf player.

Known practice aids are complicated and do not allow the necessary freedom of movement.

U.S. Pat. No. 7,117,538 B2, expressly incorporated herein by reference, discloses a jacket, in which a band is incorporated for pulling the arms to the body.

DE 202004008900 U1 discloses a stretching device, in which a forearm cup and an upper arm cup are fastened at the arm by using fixing bands. Rigid bars are fastened at the arms cup. The bars are rotatably connected to each other. A coupling element used for this purpose is biased in such a manner, that the arm is stretched. The stretching device must be individually adapted to the player. The coupling element is expensive to produce and difficult to assemble.

U.S. Pat. No. 4,070,027, expressly incorporated herein by reference, discloses a textile-type stiffening mechanism, which is slipped over the complete elbow joint.

UK 2399761 A discloses an adjustable elbow sleeve, which keeps the arm in a desired flexion.

U.S. Pat. No. 5,795,238, expressly incorporated herein by reference, discloses a band, which extends along the outside of both arms and over the shoulders to the right hand (with right-handed persons) and shall support the body movement during the swing.

SUMMARY AND OBJECTS OF THE INVENTION

It is an object of the invention, to provide a practice aid facilitating the execution of a proper motion sequence during a swing of a golf club, even for an untrained golfer.

The practice aid is preferably provided at the left arm of a right hander or at the right arm of a left hander and is designed in such a way, that the movement is manipulated during the swing in such a manner, that the rotation of the forearm of the arm provided with the practice aid against the upper arm is reduced, and a rotation of the body is supported and simultaneously allows bending the arm at the end of the swing.

The practice aid preferably comprises:

a) a first sleeve-shaped holder for immobilizing the upper arm,
b) a second, sleeve-shaped holder for immobilizing of the related forearm, and
c) an elastic band connecting the first to the second sleeve-shaped holder at the outer side of the arm, to generate a tensile strength between the first and the second holder before and during the swing.

Such a sleeve-shaped holder is, for example, applied in a similar way as a cuff for checking the blood pressure. Contrary to certain known practice aids, the practice aid of the present invention operates with simple, elastic components, where there is no risk of injuries from bars, coupling elements or the like. The production of the practice aid can be inexpensive. It is light weighted and has a high wearing comfort.

A tensile force is exerted onto the arm by an elastic band, extending on the outer side of the arm thereby causing the arm to stretch. The tensile force is provided in such a way, that a bending of the arm is possible at the end of the swing. A rotation of the forearm against the upper arm is made difficult. The forces exerted on the forearm during the swing are transformed to a desired body rotation. An undesirable bending of the spine and a risk of injuries involved therewith are avoided.

Preferably, a supporting element is provided on the elastic band in the range of the elbow. Also, means for fixing the support element to the elastic band in the range of the elbow may be provided. Thereby, the elastic band is better held in its position. The supporting element may be a cup with a hollow for surrounding the elbow. The cup may be threaded on the band. Alternatively, the support element may be directly integrated into the band. An opening may be provided in the band, suitable for securing the position of the band with respect to the elbow, so that during the swing the band remains on the outside of the arm.

In a modification of the invention, hook and loop fasteners (e.g., Velcro® brand) are provided at the first and/or second sleeve-shaped holder for immobilizing at the upper arm or the forearm. Snaps or zippers may also be useful. The use of hook and loop fasteners allows a quick application of the practice aid. Furthermore, they are well suited for adaption to the size of the arm of the golfer.

In a particularly preferred modification of the invention, an additional elastic band is provided in the range below the elbow, which is adapted to be tightened around the arm like a sleeve. The band prevents health injuries, such as the "golf elbow".

In an alternative modification of the invention, the practice aid is formed by a jacket-shaped textile upper part with at least one tubular-shaped sleeve, wherein the sleeve has a stiffening formed as a frame in the tubular-shaped sleeve and the sleeve follows the motion sequence of the golfer when swinging the golf club. This modification also reduces the rotation of the forearm of the arm with the practice aid compared to the upper arm and encourages a rotation of the body. However, the arm is freely rotatable within the sleeve. The movement is supported because the golfer feels the rotation of the forearm. The movement is supported for a correct golf swing for this strengthening of the body feeling.

The invention is based on the principle of limiting the freedom of movement of a golfer during a golf swing. Surprisingly, it has been shown that a stiffening of the sleeve designed as a frame and the accompanying restriction of the freedom of movement results in a better kinesthetic and tactile perception for a golfer. The golfer feels a compact and pleasant swing feeling for the body, leading to a very well coordinated motion sequence.

During the swinging, the limitation of the mobility may also be caused by a pure frame, which is not incorporated in a textile, but only fastened to the arm.

The practice aid according to the present invention causes an improvement of the entire motion sequence of a golf swing. Thereby, an optimal motion sequence may be achieved much faster. In particular, the practice aid advances an accurate shoulder rotation and an understanding of the rotation of the arms. In order to better maintain the angle of the arms, a higher speed of a club head is achieved and the radius of a golf swing increases. An optimal follow-through automatically affects a better weight shift to the left leg (for a right handed player).

A fast learning of the correct golf swing increases the joy of golf. In addition, sports injuries are avoided by an incorrect motion sequence. Furthermore, the inventive practice aid supports golfers with handicapped motion sequence in their game.

According to an advantageous modification of the practice aid for golfers according to the present invention, a guiding mechanism is provided, which moves the frame in a guiding course of the movement of the golfer. The guiding mechanism facilitates accurate movements and counteracts incorrect positions and movements. Thus, the arms are led to an ideal motion sequence of movement. The golfer learns the ideal golf swing quickly and directly when accomplishing the swing.

In a further preferred modification of the invention, the frame is detachably provided in the sleeve. For example, the frame is detachably fixed to the sleeve with one or more buttons, zippers, hook and loop fasteners or a combination of such fastening devices. Furthermore, an incorporation of the frame into corresponding pocket-shaped devices of the sleeve is possible. Thus, the frame can be removed from the jacket-shaped textile upper part. In doing so, the textile upper part is universally usable, e.g. as a jacket. Furthermore, a replacement of defective frames or an exchange of a frame with other qualities is easily and quickly possible.

In a practicable modification of a practice aid for golfers according to the present invention, the frame is tubular. A tubular frame provides the best possible grip and, therefore, a superior guidance of the arms during a golf swing. In addition, the frame obtains more stability from a tubular form than from other forms with the same amount of material, and can be better integrated into a sleeve. Lower material requirement has a positive effect on production costs and weight.

In a further advantageous modification of the invention, the frame extends from the sleeve onto the textile upper part. In doing so, the shoulder joint and the upper body also benefit from the movement restriction and the movement guidance. Incorrect movements and false positioning are avoided in the range of the shoulders and the upper body. This results in a more effective learning of the optimum motion sequence of the golf swing. Furthermore, injuries of the muscles or joints of the upper body due to faulty movements are prevented.

In a preferred modification of the practice aid for golfers according to the invention, the frame comprises plastic or synthetic fiber for stiffening the sleeve. Plastics or synthetic fibers are especially suitable for the frame because of their material qualities, such as low weight, high strength, elasticity and a long durability. Due to the low weight, a golfer is not handicapped. The high strength and elasticity provides a reliable stiffening of the practice aid without a risk of breakage of the frame, which could result in an injury to the user. In addition, a frame made of plastic or synthetic fiber may be easily and inexpensively produced and is easy to integrate into the textile upper part.

In a further effective modification of the invention, the frame comprises wires for stiffening the sleeve. Due to their qualities, wires are also suitable for stiffening of the textile upper part. Depending on the embodiment of the frame a use of wire, plastic, synthetic fiber or a combination of such materials will be appropriate.

According to an advantageous modification of the practice aid for golfers according to the present invention, the jacket-shaped textile upper part is comprised of a breathable fabric. Breathable fabric is resistant to water and wind. However, body moisture passes through as steam and supports the natural temperature regulation of the human body. Due to the breathable material, the jacket-shaped textile upper part safely protects the golfer from disadvantageous climatic influences such as rain or wind, and simultaneously provides a comfortable body climate. The golfer feels good in the jacket-shaped textile upper part and can better concentrate on the golf swing.

A preferred embodiment of the present invention provides plastic or synthetic fiber for the stiffening frame. These are flexible materials that, in spite of the forced movement, still provide the player with sufficient elasticity and thus comfort for the sport.

Instead of plastic or synthetic fiber, the frame can also comprise wire. The wire can also be provided in combination with the plastic or synthetic fiber. In this context the wire has similar properties as plastic or synthetic fiber in terms of elasticity, but is currently less expensive.

BRIEF DESCRIPTION OF THE DRAWINGS

Exemplary embodiments of the invention are described in greater detail herein-below with reference to the accompanying drawings, in which.

DETAILED DESCRIPTION OF THE PREFERRED EMBODIMENTS

Figure 1:
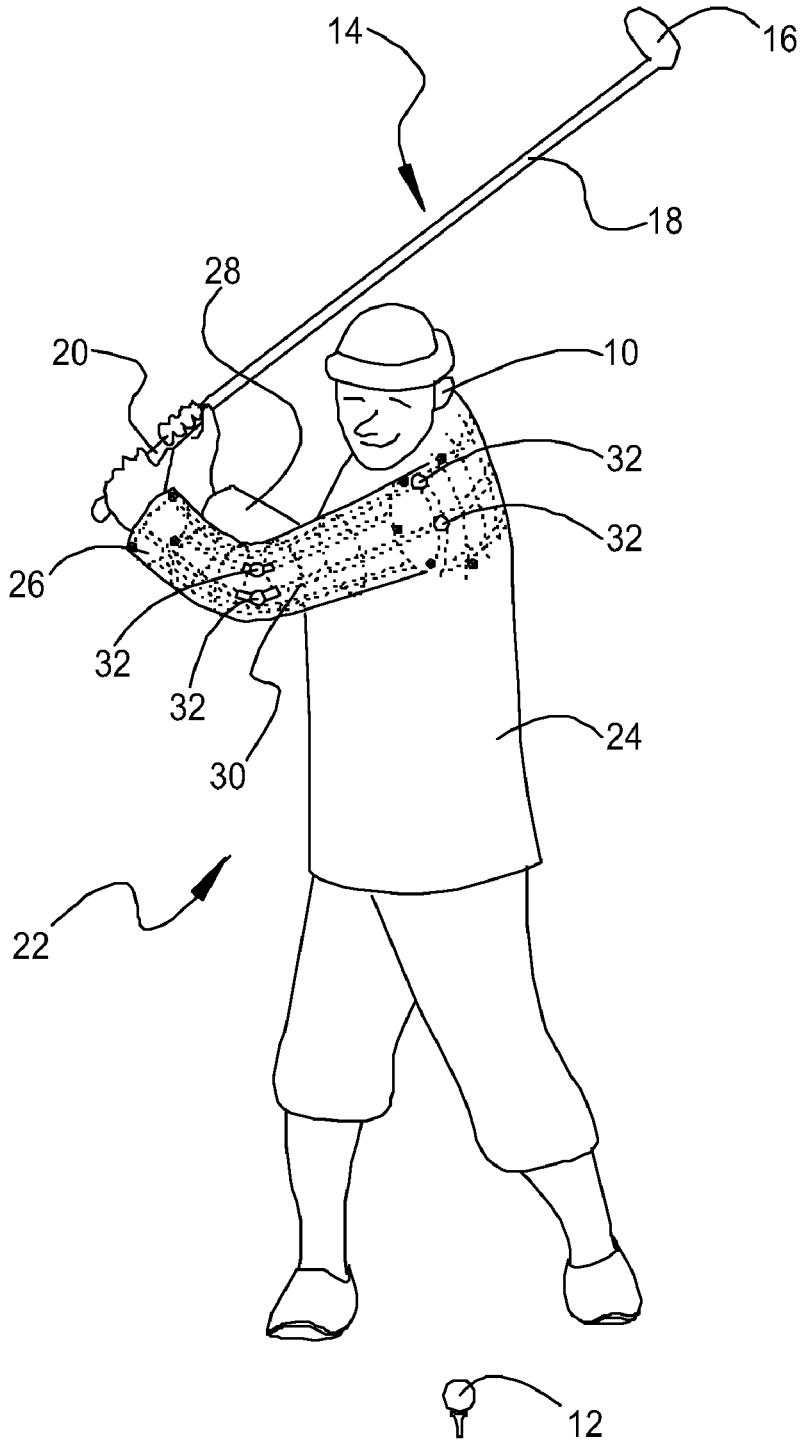
FIG. 1 shows a schematic view of a golfer with a practice aid in form of a jacket.

In FIG. 1 the numeral 10 designates a golfer executing a golf swing in order to hit a golf ball 12. For this purpose the golfer 10 uses a club 14 with a club head 16, a shaft 18 and a grip 20. The golfer 10 wears a practice aid generally designated with the numeral 22 for achieving the best possible motion sequence. The practice aid 22 comprises a textile upper part in form of a jacket 24 with two sleeves 26, 28. The sleeve 26 as well as the textile upper part 24 is stiffened by a frame 30. In an alternative embodiment, both sleeves 26, 28 are provided with frames 30 for stiffening. The frame 30 has several guiding mechanisms 32 leading it on a certain guiding course during a movement.

Figure 2:
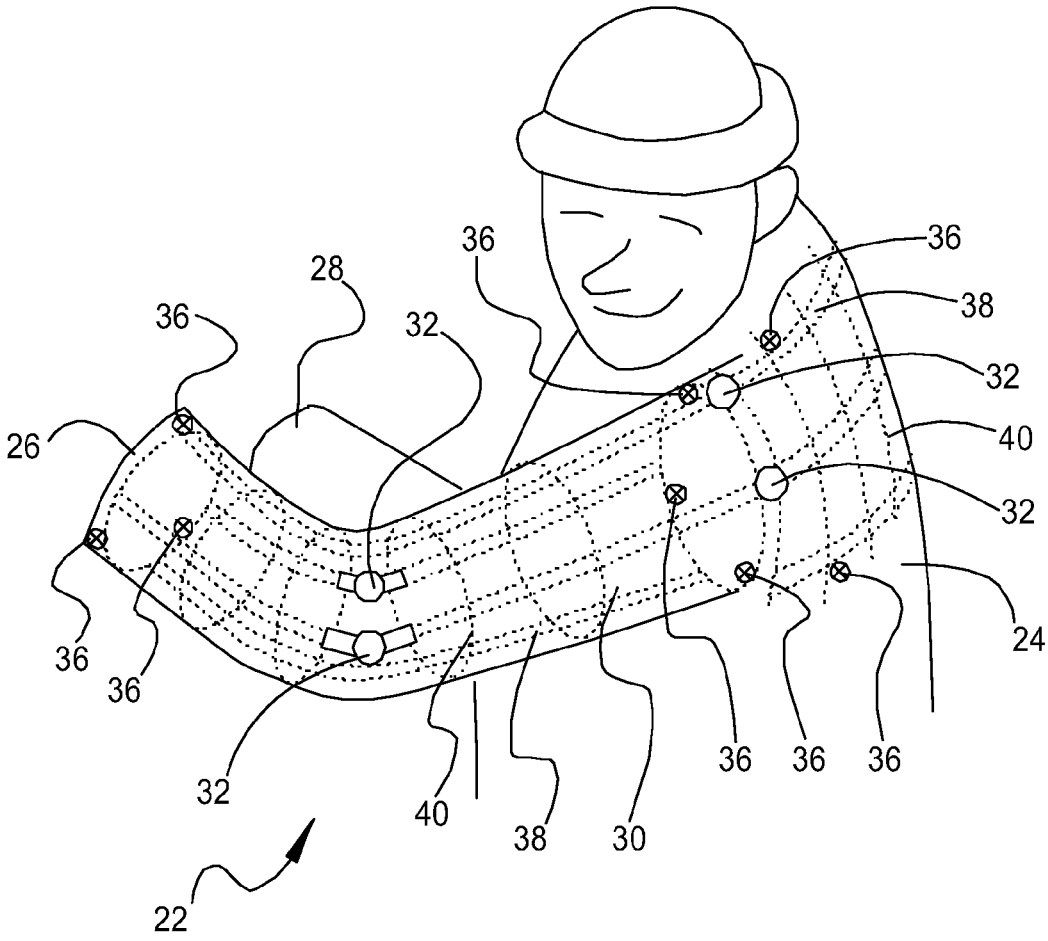
FIG. 2 shows a detailed view of the practice aid according to FIG. 1.

FIG. 2 shows a detailed section of the practice aid 22 according to FIG. 1. Corresponding elements are designated with the same reference numerals. A frame 30 is fixed to a jacket-shaped textile upper part 24 with two sleeves 26, 28 for stiffening. A tubular-shaped frame 30 is provided in the sleeve 26, and thus ensures the best possible grip to an arm and a good guiding of movements. The frame 30 extends over the sleeve 26 onto the textile upper part 24 and has guiding mechanisms 32. These are, for example, formed as joints and guide the upper body and the arms of a golfer to an optimal motion sequence during a golf swing. The stiffening creates a better feeling of movement during the swing, leading to a desired rotation of the body.

The frame 30 is detachable by means of fastenings 36, fixed to the textile upper part 24. For example, buttons, snaps, zippers or hook and loop fasteners are used as fastenings 36. In a further embodiment (not illustrated) pockets are provided for holding the frame 30 in the sleeves 26, 28 and the textile upper part 24.

In this embodiment, the frame 30 is comprised of plastic 38 and steel wire 40. A usage of other materials such as synthetic fiber, other metals, composite material or a combination of these substances is also possible. The textile upper part 24 is preferably made of breathable fabric in order to achieve a comfortable body climate when using the practice aid 22.

A golfer 10 is restricted in his freedom of movement during a golf swing by the stiffening frame 30. This leads to a better kinesthetic and tactile perception, and thus to a very well-coordinated motion sequence. The golfer 10 feels more tension during the golf swing. He will be conducted to a perfect golf swing by the stiffening frame 30. A beginner learns the golf swing faster and safer when using the practice aid 22, because injuries caused by incorrect movements or false positions are avoided.

Figure 3:
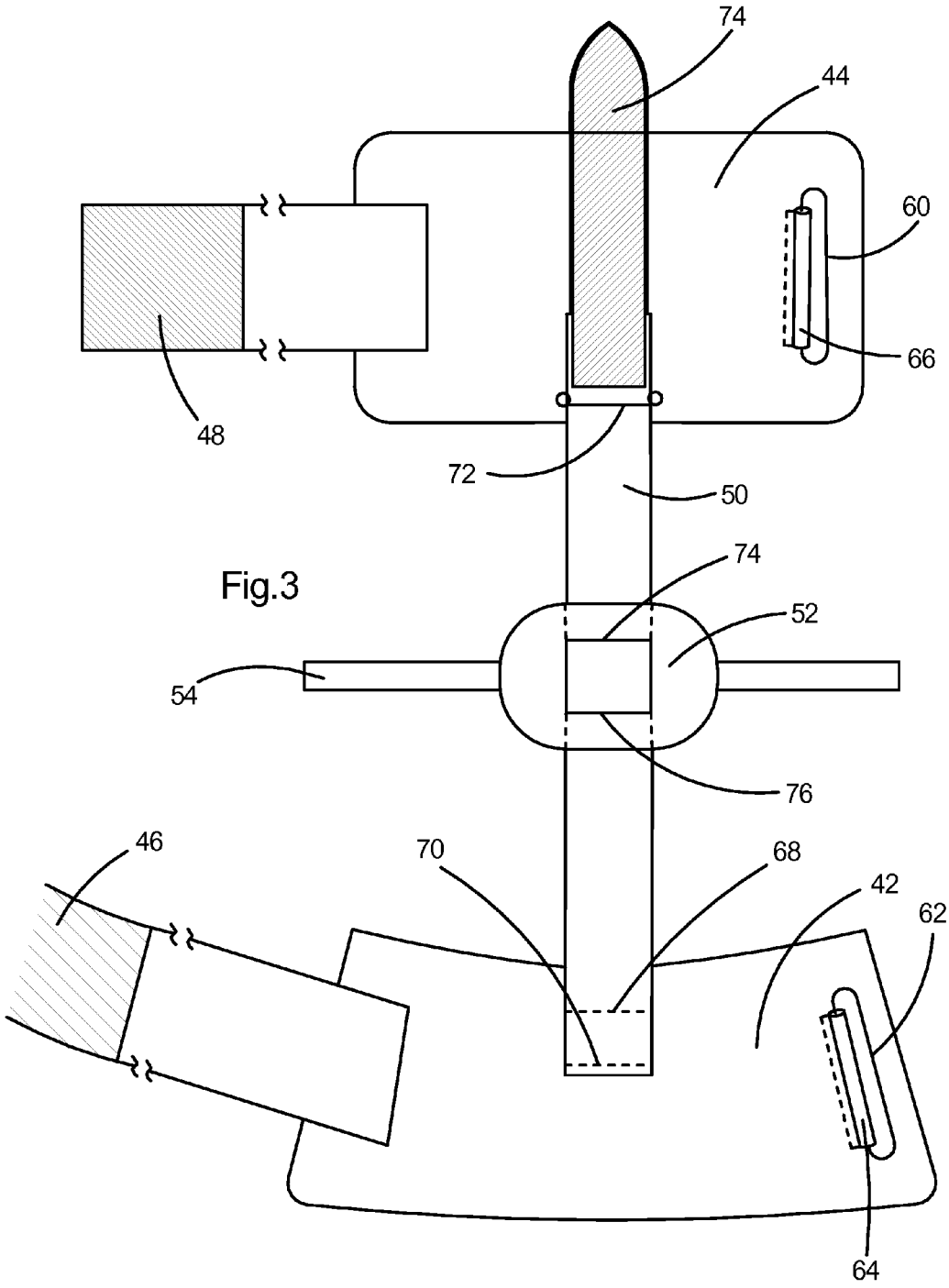
FIG. 3 shows an interior view of the practice aid with sleeves.
Figure 4:
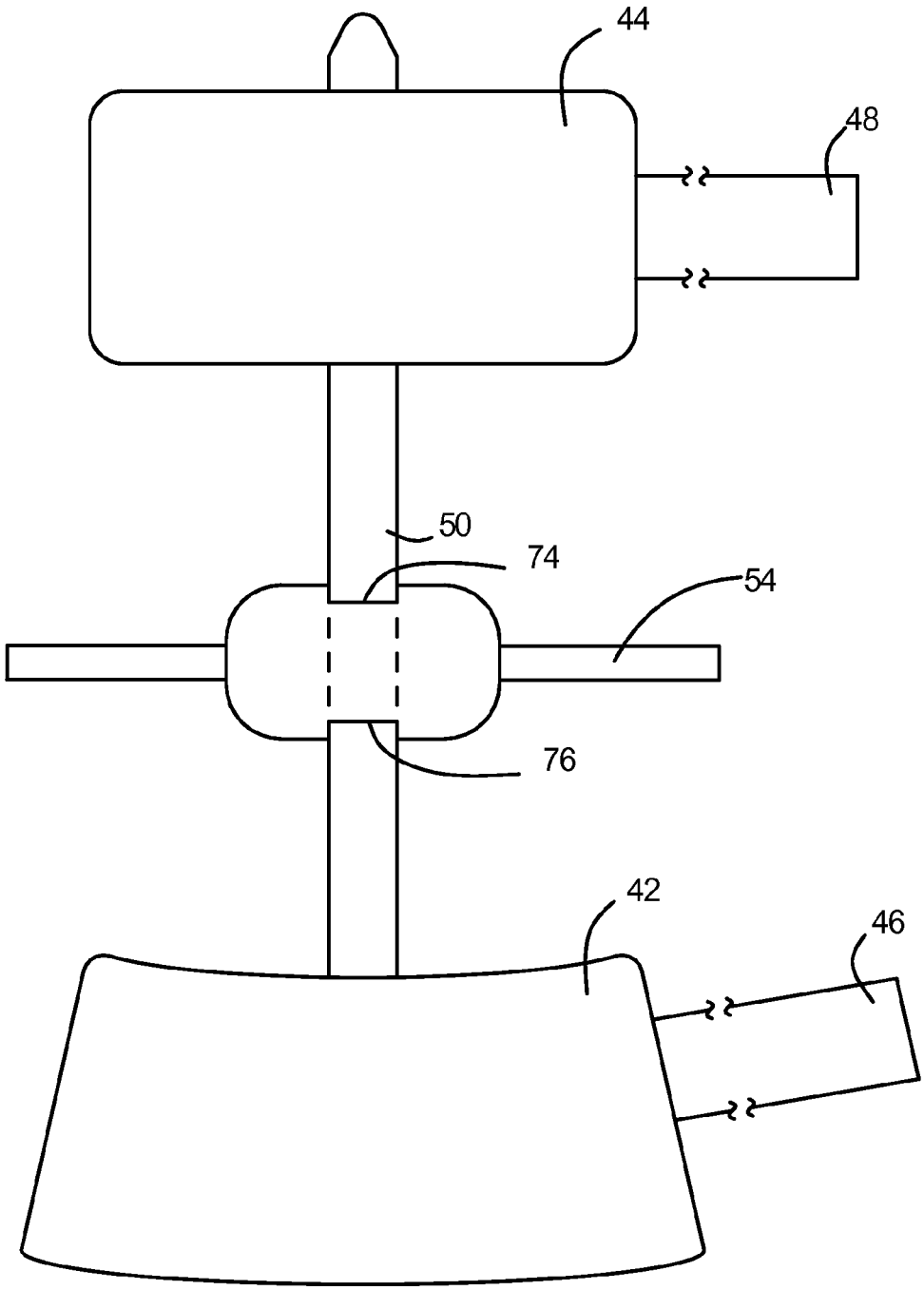
FIG. 4 shows the outside of the practice aid of FIG. 3.

In FIG. 3 and FIG. 4 another embodiment of the invention is illustrated. Essentially, in this embodiment, the practice aid 30 consists of two sleeves 42, 44. The first sleeve 42 is provided for the upper arm 43 of the left arm 45 of a golfer 10, as shown in FIG. 4. In the described embodiment, the golfer is right handed. It is obvious that the sleeve can analogously be provided on the right arm for a left handed golfer. The second sleeve 44 is provided for the forearm 49. The sleeves 42, 44 are fixed to the upper arm 43 or the forearm 49 with bands of hook and loop fasteners 46, 48 respectively. For this purpose the band is led through a metal loop 60 or 62 on the opposite side of the sleeve and is turned-over. The metal loops 60 and 62 are stitched to the outside of the sleeve by means of a reverted fabric band 64, 66. This design, with a hook and loop fastener, permits adjusting the sleeves to different arm sizes. The sleeves 42 and 44 tightly abut on the arm with the inner side and cannot slip away by forces usually occurring when accomplishing a golf swing. In alternative embodiments the bands 48 and 46 are omitted and the hook and loop fastener is provided directly on the sleeve.

The sleeves 42, 44 are connected over variable distance to each other via a connecting band 50. The connecting band 50 is stitched to the outside of the sleeve 42 by stitching 68 and 70. A metal loop 72 is stitched to the sleeve 44. The connecting band 50 is led through the metal loop 72 and is turned-over for attachment. The attachment at a desired length is carried out similar to the sleeves by means of a hook and loop fastener 74.

The connecting band 50 is guided over the elbow 51 of the left arm 45 of the (right handed) golfer 10. In the range of the elbow 51, a support element 52 is provided for fixation of the elbow 51. For this purpose the support element 52 is threaded onto the band 50 with two slots 74 and 76. The slots 74 and 76 are large enough so that the support element 52 is moveable. Hence, the position of the supporting element 52 can be adjusted in such a way that it precisely abuts on the elbow. In doing so, the connecting band 50 is fixed in its position on the outside of the arm. The supporting element is made of foamed plastic material. On the inside it is provided with a hollow in which the elbow rests.

In addition to the practice aid with sleeves as shown in FIG. 3 and FIG. 4, a band 54 can be put around the hitting arm, which is fixed with a hook and loop fastener. With this band damage caused to health called "golf elbow" is prevented.

Figure 5:
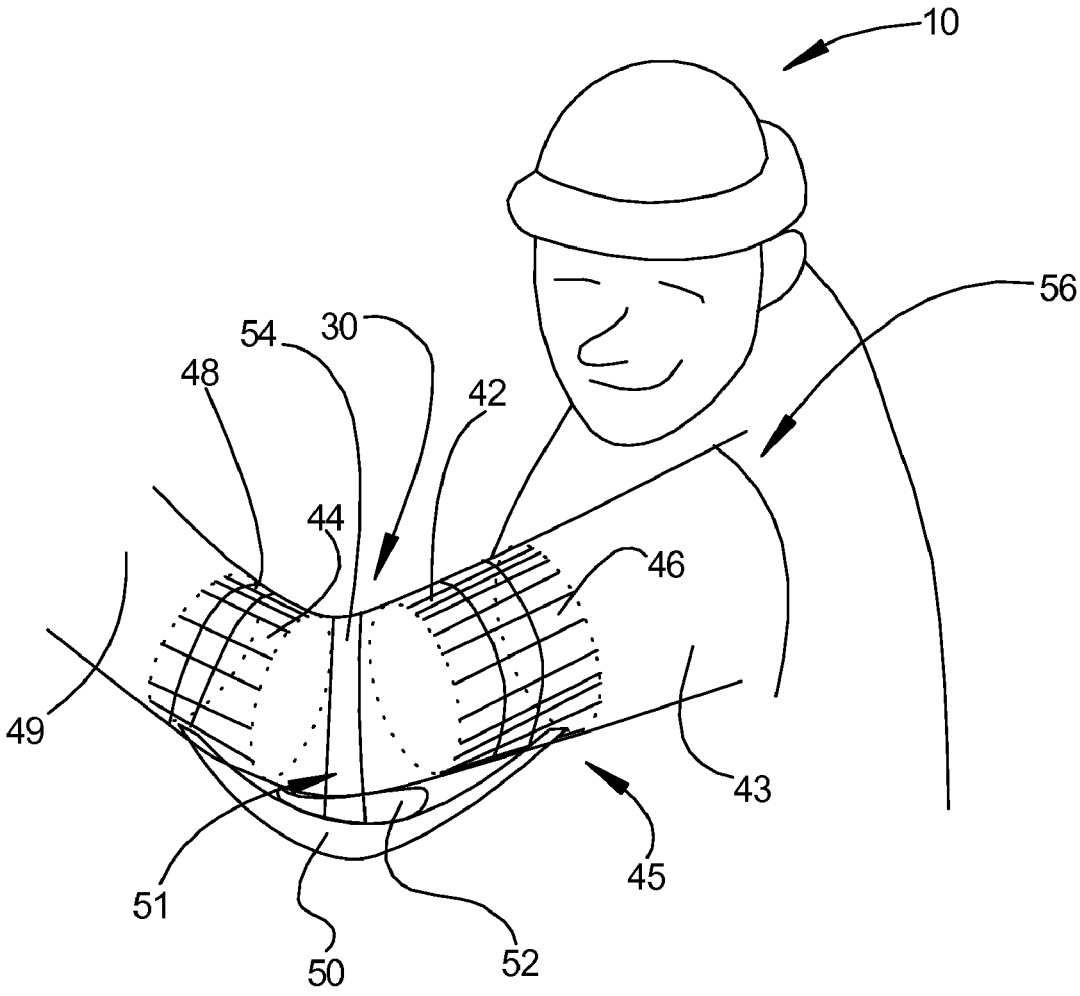
FIG. 5 shows the practice aid of FIGS. 3 and 4 in applied status.

FIG. 5 shows how the practice aid 30 is applied around the left arm 45 of the right handed golfer 10. Due to the sleeves 42, 44 as well as the immobilizing of the elbow 51 by the support element 52, the arm is stretched and fixed in this stretched position. Thus, the golfer 10 is forced to convert the rotary motion of the forearm 49 over his shoulder 56 into a rotary motion of the body. This motion sequence is particularly advantageous from an orthopedic viewpoint. In this way a painful inflammation known as epicondylitis is prevented effectively. Epicondylitis often occurs in golfers and is known under the term "tennis elbow". This inflammation primarily emerges due to an inappropriate strain on the arm 45 of the golfer 10.

What is claimed is:

1. A practicing aid for golfers influencing the motion sequence of the golfer when swinging with the golf club, wherein said practice aid is provided at the left arm of a right hander or at the right arm of a left hander and is designed in such a way, that the movement is manipulated during the swing in such a manner, that the rotation of the forearm of the arm provided with said practice aid against the upper arm is reduced and a rotation of the body is supported and simultaneously allows bending the arm at the end of the swing, wherein a) a first sleeve-shaped holder for immobilizing to the upper arm, b) a second, sleeve-shaped holder for immobilizing to the related forearm, and c) an elastic band, which connects said first sleeve-shaped holder at a variable distance from said second sleeve-shaped holder at the outside of the arm, to generate a tensile force between said first and said second holder before and during the hit.

2. A practice aid for golfers according to claim 1 wherein a supporting element is provided on said elastic band in the range of the elbow.

3. A practice aid for golfers according to claim 2 wherein means are provided for fixing said support element to said elastic band in the range of the elbow.

4. A practice aid for golfers according to claim 1 wherein plastic material or synthetic fiber material is provided for stiffening.

5. A practice aid for golfers according to claim 1 wherein hook and loop fasteners are provided at said first and/or second sleeve-shaped holder for immobilizing to the upper arm or the forearm.

6. A practice aid for golfers according to claim 1 wherein an additional elastic band is provided in the range below the elbow, which is adapted to be tightened around the arm like a sleeve.

7. A practice aid for golfers according to claim 1 wherein said practice aid is formed by a jacket-shaped textile upper part with at least one tubular-shaped sleeve, wherein said sleeve has a stiffening formed as a frame in said tubular-shaped sleeve and said sleeve follows the motion sequence of the golfer when swinging the golf club, wherein a guiding mechanism is provided, which moves said frame in a guiding course of the movement of the golfer.

8. A practice aid for golfers according to claim 7 wherein said frame is provided detachable in said sleeve.

9. A practice aid for golfers according to claim 7 wherein said frame extends from said sleeve onto said textile upper part.

10. A practice aid for golfers according to claim 7 wherein said frame comprises plastic or synthetic fiber and/or wire for stiffening said sleeves (26, 28).

11. A practice aid for golfers, adapted to control a motion sequence of the golfer when swinging with the golf club, comprising:

a) a first sleeve-shaped holder for immobilizing to an arm of a golfer above an elbow;

b) a second sleeve-shaped holder for immobilizing a forearm of the golfer below the elbow, and c) an elastic band, connecting the first and second sleeve-shaped holders on an outer side the arm, proximate to the elbow, to generate a tensile force between the first and the second holder before and during a golf swing, wherein said elastic band is adapted to connect said first and second sleeve-shaped holder over a variable distance to each other, the practice aid being adapted, when provided at the left arm of a right hander or at the right arm of a left hander, to guide a movement of the golfer during the swing such that a rotation of the forearm with respect to the upper arm is reduced, and a rotation of a body of the golfer is supported, the practice aid being further adapted to permit a bending the elbow at a termination of the golf swing.

12. A practice aid for golfers according to claim 11, further comprising a supporting element provided on the elastic band proximate to the elbow.

13. A practice aid for golfers according to claim 12, further comprising an attachment adapted to fix the support element to the elastic band proximate to the elbow.

14. A practice aid for golfers according to claim 12, further comprising an additional elastic band provided distal to the elbow, adapted to be tightened around the forearm like a sleeve.

15. A practicing aid for golfers influencing the motion sequence of the golfer when swinging with the golf club, wherein said practice aid is formed having a jacket-shaped textile upper part with at least one tubular-shaped sleeve, wherein the tubular-shaped sleeve has a stiffening frame formed and the sleeve is adapted to follow the motion sequence of the golfer when swinging a golf club, and wherein a guiding mechanism is provided which moves the frame during swinging of the golf club, to guide course of the movement of the golfer, and said practice aid being configured, when provided at the left arm of a right hander or at the right arm of a left hander, to guide a movement of the golfer during the swing such that a rotation of the forearm with respect to the upper arm is reduced and a rotation of a body of the golfer is supported, the practice aid being further configured to permit a bending of the elbow at a termination of the golf swing.

16. A practice aid for golfers according to claim 15, wherein the frame is detachable from the sleeve.

17. A practice aid for golfers according to claim 15, wherein the frame extends from the sleeve onto the textile upper part.

18. A practice aid for golfers according to claim 15, further comprising an additional elastic band provided in a range below the elbow, which is configured to be tightened around the arm like a sleeve.

19. A practice aid for golfers according to claim 15, further comprising:

a) a first sleeve-shaped holder comprising the jacket-shaped textile upper part, configured to immobilize an upper arm of the golfer, b) a second, sleeve-shaped holder, configured to immobilize to a forearm below the upper arm of the golfer, and c) an elastic band, configured to connect said first sleeve-shaped holder at an adjustable variable distance from said second sleeve-shaped holder at the outside of the arm, to generate a tensile force between said first and said second holder before and during the hit.

20. A practice aid for golfers influencing the motion sequence of the golfer when swinging with the golf club, wherein said practice aid is provided at a left arm of a right hander or at a right arm of a left hander, and is configured such that a movement of the golfer during a swing is manipulated in such a manner, that a rotation of a forearm of an arm provided with said practice aid with respect to a respective upper arm is reduced, and a rotation of the golfer's body is supported, and the practice aid simultaneously allows bending the elbow at the end of the swing, wherein said practice aid is formed by a jacket-shaped textile upper part with at least one tubular-shaped sleeve having a stiffening formed as a frame within said tubular-shaped sleeve, and said tubular-shaped sleeve follows a motion sequence of the golfer when swinging a golf club, wherein a guiding mechanism is provided, which moves said frame in a guiding course of the movement of the golfer.

* * * * *